US009140059B2

(12) United States Patent
Kirk et al.

(10) Patent No.: US 9,140,059 B2
(45) Date of Patent: Sep. 22, 2015

(54) VENETIAN TYPE BLIND OPERATOR

(71) Applicant: Sunrise Windows, LLC, Temperance, MI (US)

(72) Inventors: Douglas A. Kirk, Toledo, OH (US); Michael Williamson, Toledo, OH (US); John H. Walsh, Oregon, OH (US); Daniel Dew, Taylor, MI (US)

(73) Assignee: Sunrise Windows, LLC, Temperance, MI (US)

( * ) Notice: Subject to any disclaimer, the term of this patent is extended or adjusted under 35 U.S.C. 154(b) by 0 days.

(21) Appl. No.: 13/998,887

(22) Filed: Dec. 17, 2013

(65) Prior Publication Data

US 2014/0208652 A1 Jul. 31, 2014

Related U.S. Application Data

(60) Provisional application No. 61/797,913, filed on Dec. 17, 2012.

(51) Int. Cl.
*E06B 9/264* (2006.01)

(52) U.S. Cl.
CPC ..... *E06B 9/264* (2013.01)

(58) Field of Classification Search
CPC ..... E06B 9/264; E06B 9/32; E06B 9/52
USPC ..... 49/61, 62, 63, 64, 65, 67; 160/90, 92, 160/107
See application file for complete search history.

(56) References Cited

U.S. PATENT DOCUMENTS

| | | | | | |
|---|---|---|---|---|---|
| 1,615,632 | A | * | 1/1927 | Kinnear | 49/87.1 |
| 2,209,384 | A | * | 7/1940 | Brown | 49/82.1 |
| 2,301,150 | A | * | 11/1942 | Sienicki | 160/90 |
| 2,311,300 | A | * | 2/1943 | Dubour et al. | 160/95 |
| 2,878,667 | A | | 3/1959 | Jones | |
| 3,366,159 | A | | 1/1968 | Arnold et al. | |
| 4,274,469 | A | | 6/1981 | Kuyper et al. | |
| 4,588,012 | A | * | 5/1986 | Anderson | 160/174 R |
| 4,611,648 | A | | 9/1986 | Anderson | |
| 4,768,576 | A | * | 9/1988 | Anderson | 160/107 |
| 4,913,213 | A | | 4/1990 | Schnelker | |
| 5,000,242 | A | * | 3/1991 | Coddens | 160/107 |
| 5,226,466 | A | * | 7/1993 | Coddens | 160/107 |
| 5,497,820 | A | | 3/1996 | Drake, III | |
| 5,699,845 | A | | 12/1997 | Jelic | |
| 5,996,668 | A | * | 12/1999 | DeBlock et al. | 160/107 |
| 6,065,524 | A | * | 5/2000 | Rossini | 160/107 |
| 6,119,756 | A | * | 9/2000 | Tatro | 160/107 |

(Continued)

FOREIGN PATENT DOCUMENTS

GB 2252349 8/1992

*Primary Examiner* — Katherine Mitchell
*Assistant Examiner* — Justin Rephann
(74) *Attorney, Agent, or Firm* — David C. Purdue

(57) ABSTRACT

A window assembly comprising a window frame and a window sash is disclosed. The sash is supported on the window frame for pivotal movement between an open position and a closed position. The sash supports an insulated glass unit with an internal blind and includes a primary operator connected to the blind so that linear movement of the primary operator causes movement of said blind. When the sash is closed, a secondary operator supported in the window frame engages the primary operator so that linear movement of the secondary operator causes a corresponding linear movement of the primary operator.

17 Claims, 5 Drawing Sheets

(56) References Cited

U.S. PATENT DOCUMENTS

| | | | | |
|---|---|---|---|---|
| 6,401,790 | B1 | 6/2002 | Dai et al. | |
| 6,571,851 | B1 * | 6/2003 | Jelic et al. | 160/84.06 |
| 6,932,139 | B2 * | 8/2005 | Early et al. | 160/107 |
| 6,957,680 | B2 * | 10/2005 | Anderson et al. | 160/84.05 |
| 7,066,233 | B2 * | 6/2006 | Scharff et al. | 160/371 |
| 7,637,063 | B2 * | 12/2009 | Sensini | 52/302.1 |
| 8,376,019 | B2 * | 2/2013 | Van Klompenburg et al. | 160/107 |
| 2003/0066614 | A1 * | 4/2003 | Sun et al. | 160/107 |
| 2003/0173036 | A1 * | 9/2003 | Kwon et al. | 160/107 |
| 2004/0011476 | A1 * | 1/2004 | Schroder et al. | 160/107 |
| 2004/0069417 | A1 * | 4/2004 | Sun et al. | 160/107 |
| 2005/0103449 | A1 * | 5/2005 | Scharff et al. | 160/107 |
| 2006/0130980 | A1 * | 6/2006 | Gromotka et al. | 160/107 |
| 2006/0169418 | A1 * | 8/2006 | Gromotka et al. | 160/107 |
| 2008/0029226 | A1 * | 2/2008 | Huang | 160/107 |

* cited by examiner

VENETIAN TYPE BLIND OPERATOR

CROSS-REFERENCE TO RELATED APPLICATIONS

None.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC

Not applicable.

BACKGROUND OF THE INVENTION

1. Field of the Invention

This invention concerns the field of fenestration products and, more specifically, to windows provided with internal Venetian blinds and operators therefor.

2. Background of the Invention

In a prior art search directed to the subject invention, the following US Patents were noted: U.S. Pat. Nos. 6,401,790; 5,699,845; 5,497,820; 4,913,213; 4,611,648; 4,274,469; 3,366,159; and 2,878,667. In addition, UK Patent Application No. 2,252,349 was noted.

BRIEF SUMMARY OF THE INVENTION

The present invention is an inside operator for controlling a primary operator for controlling a Venetian type blind that is in an insulated glass unit comprising two spaced glass panes. The insulated glass unit is supported in a sash frame which is supported on a window frame for pivotal movement between an open position and a closed position, as is the case, for example, with casement type windows and awning type windows. The primary operator may be one that controls the tilt orientation of the Venetian type blind slats or one that controls the vertical position of the bottom of the blind so as to raise and lower the blind. The primary operator is carried in the sash frame. The primary operator is supported in a longitudinally extending slot for longitudinal movement therein and may be operably connected to a slat tilt mechanism so that longitudinal movement of the primary operator effects a corresponding change in the tilt orientation of the slats. Alternatively, the primary operator may be operably connected to a mechanism for raising and lowering the blind so that longitudinal movement of the primary operator raises or lowers the blind. From the inside of the window frame, access to the primary operator is limited and access often requires the removal of a screen or a storm window from the window frame.

The inside operator is carried in the window frame and is supported for longitudinal movement within a longitudinally extending slot. When the window sash is open, the inside operator does not engage the primary operator and longitudinal movement of the inside operator has no effect on the position of the primary operator provided in the window sash.

When the window sash is closed, arms or prongs provided on the inside operator operably engage a boss portion of the primary operator so that, when the primary operator and the inside operator are aligned, longitudinal movement of the inside operator effects a corresponding longitudinal movement of the primary operator. When the window sash is closed and the operators are not aligned, longitudinal movement of the inside operator will bring the operators into alignment so that the prongs engage the boss and subsequent longitudinal movement of the inside operator effects a corresponding movement of the primary operator. In the case where the primary operator is operably connected to a slat tilt mechanism, longitudinal movement of the inside operator, when the window sash is closed and the inside operator and the primary operator are aligned, effects a corresponding change in the tilt orientation of the slats. In the case where the primary operator is operably connected to a mechanism for raising and lowering the blind, longitudinal movement of the inside operator, when the window sash is closed and the operators are aligned, raises or lowers the blind.

Accordingly, it is an object of the invention to provide an operator for controlling a Venetian type blind carried in a pivoting window sash, even when access to the sash is restricted, for example, by a screen or a storm window.

It is another object of the invention to provide an inside operator for controlling the longitudinal position of a primary operator which is operably connected to a tilt mechanism for controlling the tilt orientation of the slats of a Venetian type blind carried in a pivoting window sash.

It is another object of the invention to provide an inside operator for controlling the longitudinal position of a primary operator which is operably connected to a mechanism for raising or lowering a Venetian type blind carried in a pivoting window sash.

It is another object of the invention to provide an inside operator with arms or prongs that are operable to engage a boss provided on a primary operator so that longitudinal movement of the inside operator effects a corresponding longitudinal movement of the primary operator.

It is another object of the invention to provide an inside operator with arms that engage a boss on a primary operator when they are aligned wherein longitudinal movement of the inside operator when the boss and the arms are not aligned will bring the arms and the boss into alignment and engagement.

It is another object of the invention to provide an inside operator that can be moved longitudinally to control the tilt orientation of the slats of a Venetian type blind carried in a casement window sash without the need to remove a screen or other object that effectively closes the casement window frame.

It is another object of the invention to provide an inside operator that can be moved longitudinally to raise or lower a Venetian type blind carried in a pivoting window sash without the need to remove a screen or a storm window or another object that effectively closes the pivoting window frame.

These and many other objects and advantages of the invention will be understood by persons skilled in the art who study the following description and the accompanying drawings which, although thorough, are merely illustrative.

DETAILED DESCRIPTION OF THE INVENTION

Figure 1:
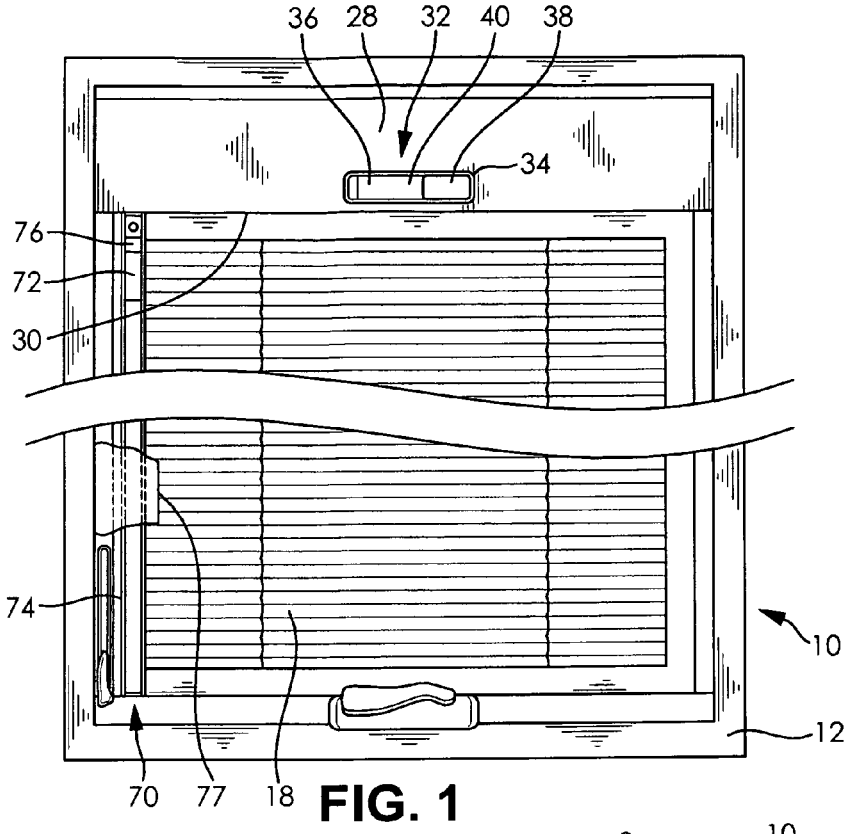
FIG. 1 is an inside view of a casement type window unit including a Venetian type blind in between panes of glass in an insulated glass unit in the casement window sash.
Figure 2:
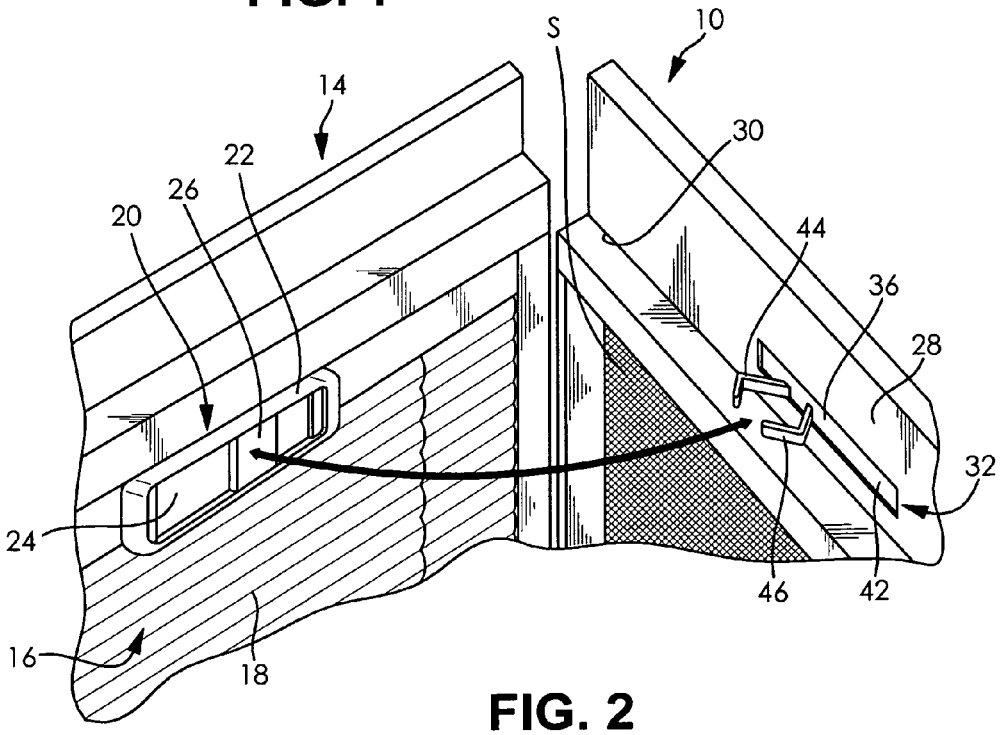
FIG. 2 is an upper perspective view of the casement window unit with the sash in an open position.
Figure 3:
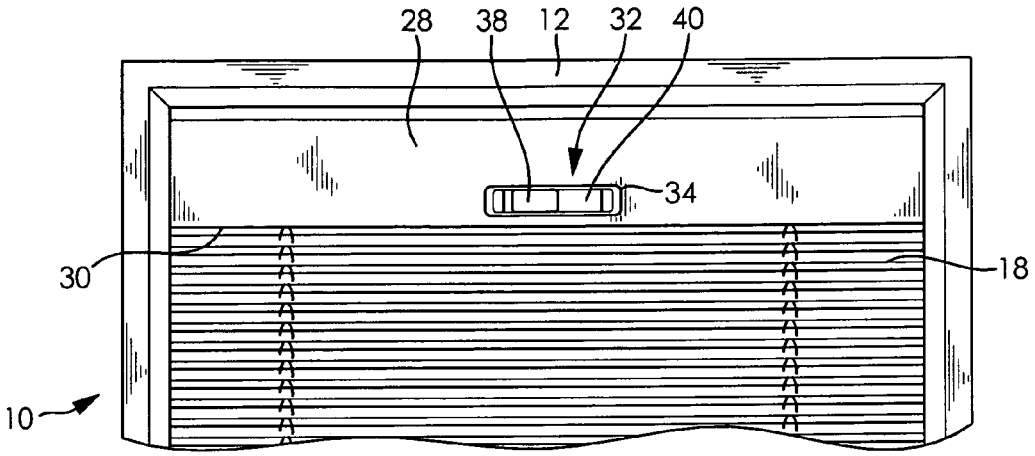
FIG. 3 is an inside view of the casement window unit shown in FIG. 1 with the slats of the Venetian type blind in an open tilt orientation.

In FIGS. 1, 2 and 3, a window unit of the pivoting casement type is indicated generally at 10. The window 10 comprises a window frame 12 and a sash 14 mounted for pivotal movement about a vertical axis relative to the window frame 12. The invention also can be embodied in a window unit having a sash 14 that pivots about a horizontal axis such as an awning type window (not shown). An insulated glass unit 16 is supported in the sash 14 and a Venetian type blind 18 is enclosed within the insulated glass unit 16. A primary operator 20 is supported on the sash 14.

The primary operator 20 comprises a housing 22 and a slider 24 mounted for longitudinal movement within the housing 22. A raised boss 26 is provided on the slider 24 for facilitating finger control of longitudinal movement thereof. The slider 24 is operably connected to apparatus (not shown) inside of the insulated glass unit 16 in the sash 14 so that longitudinal movement of the slider 24 is translated into rotational movement of the slats in the blind 18. One such apparatus is available from OEM Shades under the name TOPSLIDE INTERNAL GLASS BLIND SYSTEM. The apparatus is described by OEM Shades as follows: "A top mounted external magnet assembly controls the blind with a movable finger controlled slide device. The slide device moves the external magnet laterally left or right, which drives an internal magnet with which it is coupled. Moving the slide device left or right on the outer magnet assembly will tilt the blind." Other apparatus for translating longitudinal movement of a slide device or slider into rotational movement of blind slats are now known and may be developed in the future and they are to be considered to be apparatus for translating longitudinal movement of a slider into rotational movement of blind slats for purposes of this invention. The slats of the shade 18 are open when the slider 24 is moved to the left, as in FIG. 3, and the slats of the shade 18 are closed when the slider 24 is moved to the right, as in FIG. 1.

Unlike some prior art designs, the window frame 12 includes a head frame insert 28 which has a bottom edge 30 that is positioned below the height of the primary operator 20. An inside operator 32 is supported on the head frame insert 28. The inside operator 32 comprises a housing 34 and a slider 36 mounted for longitudinal movement relative to the head frame insert 28 which is part of the window frame 12. A boss 38 is provided on a front face 40 of the slider 36. The front face 40 is seen in FIGS. 1 and 3 and faces the room in which the window unit 10 is supported. On a rear face 42 of the slider 36 there are first and second prongs or arms 44 and 46.

Figure 4:
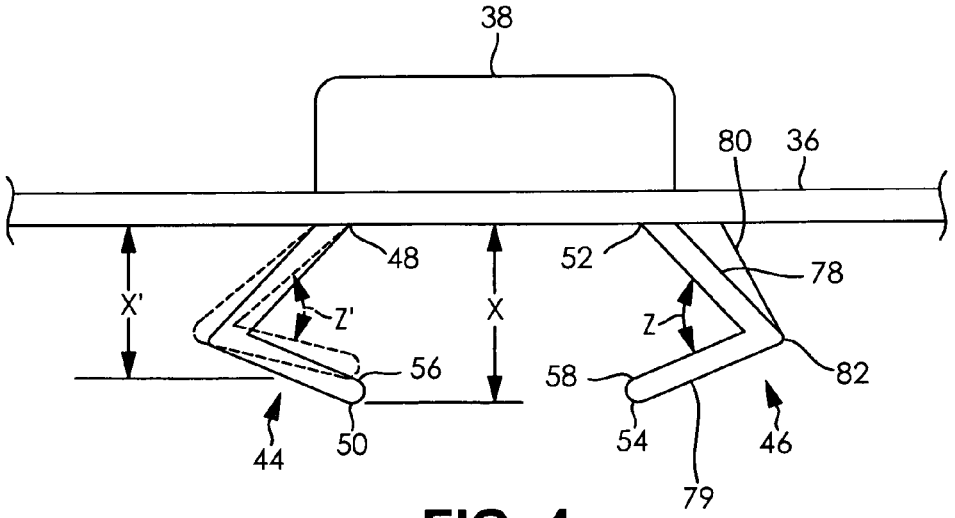
FIG. 4 is a top view of an inside operator according to one example of the invention.

The prongs 44 and 46 are shown in more detail in FIG. 4. The prong 44 comprises a first end 48 supported on the slider 36. The prong 44 further comprises a second, free end 50. The prong 46 comprises a first end 52 which is supported on the slider 36 and further comprises a second, free end 54. A contact surface 56 is provided near the free end 50 of the prong 44 and a contact surface 58 is provided near the free end 54 of the prong 46. As explained below, the contact surfaces 56 and 58 are operable to selectively engage the boss 26 of the primary operator 20 so that longitudinal movement of the slider 36 of the inside operator 32 is translated into longitudinal movement of the slider 24 of the primary operator 20 when the sash 14 is closed.

Figure 5:
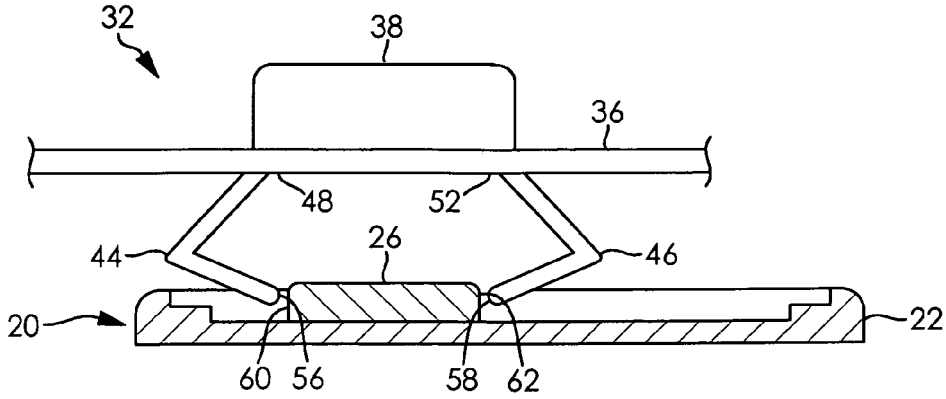
FIG. 5 is atop view of an inside operator aligned with a primary operator in a first position.

In FIG. 5, the inside operator 32 and the primary operator 20 are spaced apart a fixed distance as they would be when the sash 14 is closed. FIG. 5 shows the operators 20 and 32 in an aligned condition. The free ends 50 and 54 of the prongs 44 and 46 are positioned on either side of the boss 26 of the primary operator 20. The contact surface 56 of the prong 44 is adjacent to a contact surface 60 on one side of the boss 26 and the contact surface 58 of the prong 46 is adjacent to a contact surface 62 on the other side of the boss 26.

Figure 6:
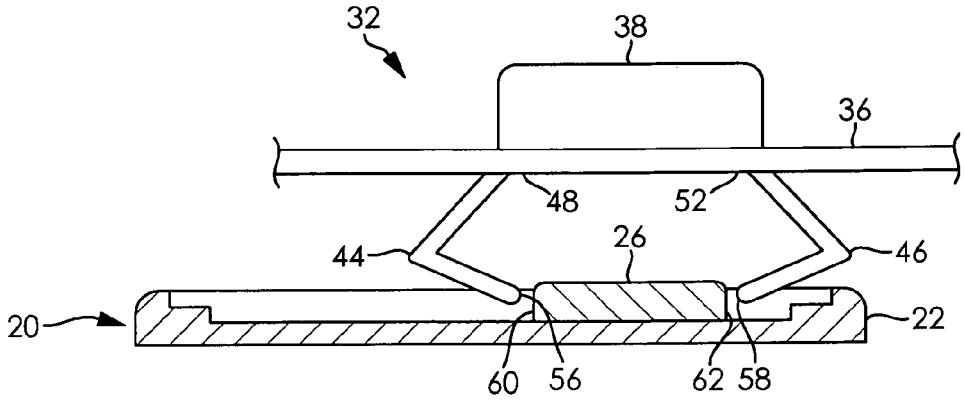
FIG. 6 is a top view of an inside operator aligned with a primary operator in a second position.

Longitudinal movement of the slider 36 of the inside operator 32 from the position shown in FIG. 5 to the right, for example, to the position shown in FIG. 6, effects a corresponding longitudinal movement of the slider 24 (FIG. 2) of the primary operator 20 to the right to the position shown in FIG. 6. Longitudinal movement of the slider 36 is transmitted to the slider 24 in this case by co-action between the contact surface 56 of the prong 44 and contact surface 60 of the boss 26. Thus, longitudinal movement of the slider 36 to the right causes corresponding longitudinal movement of the slider 24 of the primary operator 20 to the right.

Longitudinal movement of the slider 36 of the inside operator 32 from the position shown in FIG. 6 to the left, for example, to the position shown in FIG. 5, effects a corresponding longitudinal movement of the slider 24 (FIG. 2) of the primary operator 20 to the left to the position shown in FIG. 5. In this case, longitudinal movement of the slider 36 is transmitted to the slider 24 by co-action between the contact surface 58 of the prong 46 and contact surface 62 of the boss 26. Thus, longitudinal movement of the slider 36 to the left causes corresponding longitudinal movement of the slider 24 to the left. In FIGS. 5 and 6, the primary operator 20 is aligned with the inside operator 32 and vice-versa.

The prongs 44 and 46 are yieldingly rigid. When not subjected to any force, the free end 50 is spaced a fixed distance X (FIG. 4) from the slider 36 and the free end 54 is also spaced a fixed distance from the slider 36. If a force is applied to the free end 50 in the direction of the slider 36, the prong 44 will flex as indicated in dotted lines in FIG. 4. When the prong 44 flexes this way, the distance between the slider 36 and the free end 50 is reduced, for example, to a distance X'. When the prong 44 is flexed, it is biased to return to its not flexed condition. This feature solves problems that can arise when the primary operator 20 and the inside operator 32 are not aligned and the sash 14 has been pivoted to the closed position, as discussed below.

Figure 7:
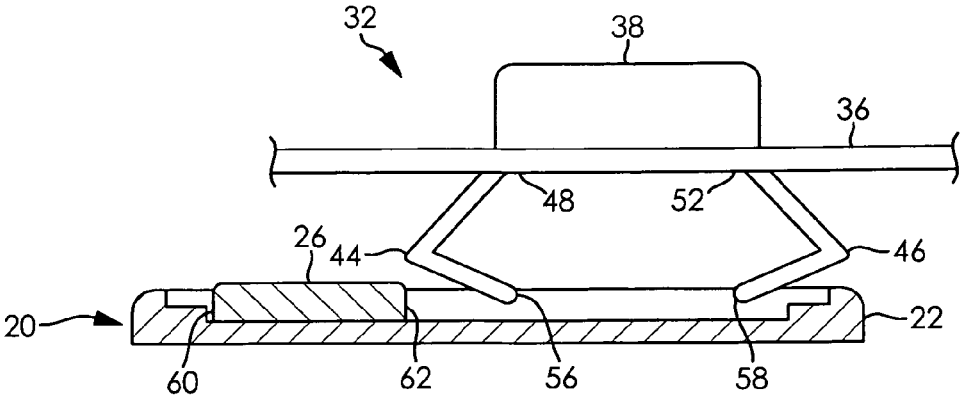
FIG. 7 is a top view of an inside operator not aligned with a primary operator.

In FIG. 7, the operators 20 and 32 are spaced apart as they would be when the sash 14 is closed but the primary operator 20 and the inside operator 32 are not aligned. The prongs 44 and 46 are positioned to the right of the boss 26 and longitudinal movement of the slider 36 does not affect the longitudinal position of the primary operator.

Figure 8:
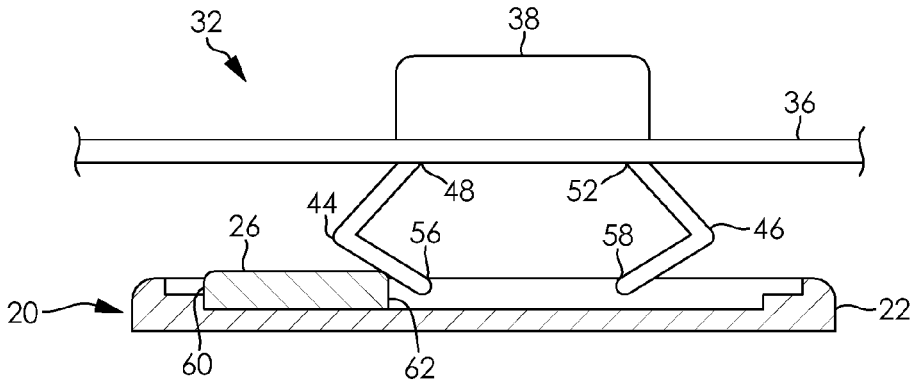
FIG. 8 is a top view of an inside operator touching but not aligned with a primary operator.

In FIG. 8, the operators 20 and 32 are spaced apart as they would be when the sash 14 is closed and the primary operator 20 and the inside operator 32 are not aligned. The slider 36 has been moved to the left from the position shown in FIG. 7 until a portion of the prong 44 is touching the right side of the boss 26. The contact surface 56 of the prong 44 is not engaged with the contact surface 60 of the boss 26.

Figure 9:
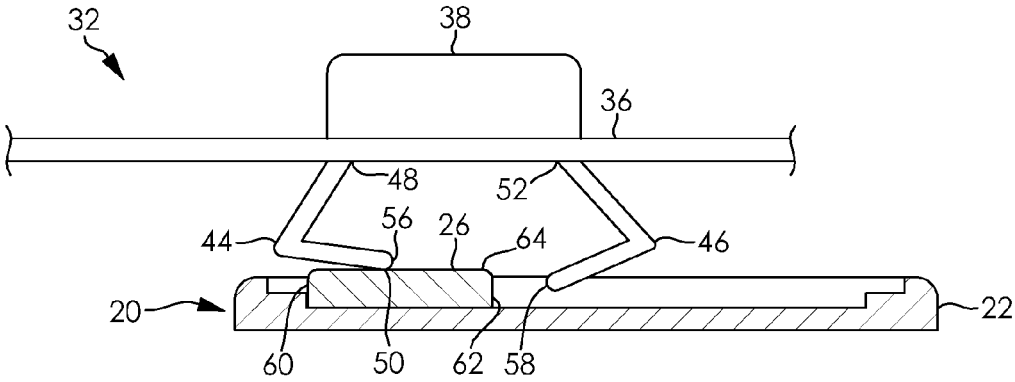
FIG. 9 is a top view of an inside operator touching and nearly aligned with a primary operator.
Figure 10:
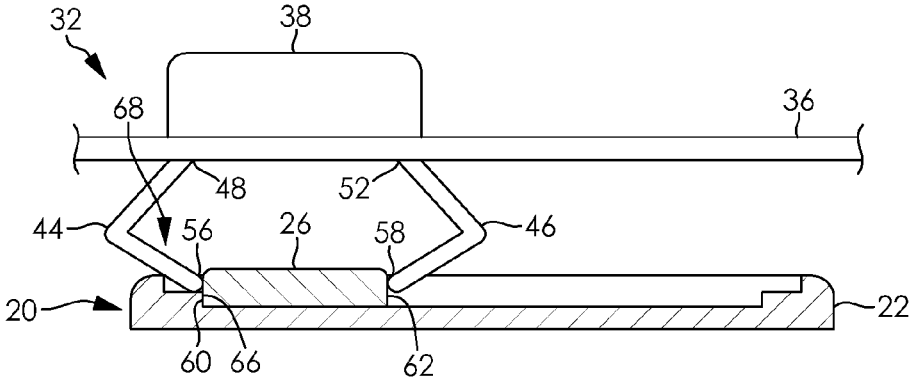
FIG. 10 is a top view of an inside operator aligned with a primary operator.

In FIG. 9, the operators 20 and 32 are spaced apart as they would be when the sash 14 is closed and the primary operator 20 and the inside operator 32 are not aligned. The inside operator 32 has been moved to the left from the position shown in FIG. 9 so that co-action between the prong 44 and the boss has caused the prong 44 to flex and the free end 50 of the prong 44 is in contact with an upper contact surface 64 of the boss 26. The prong 44 is prevented from assuming a not flexed condition although the prong 44 is biased to return to a not flexed condition. The contact surface 56 of the prong 44 is not adjacent to or in contact with the contact surface 60 of the boss 26 and the contact surface 58 of the prong 46 is not adjacent to or in contact with the side contact surface 62 of the boss 26.

As the inside operator 36 is moved longitudinally to the left from the position shown in FIG. 7 through the positions shown in FIGS. 8 and 9, the boss 26 co-acts with a contact surface 66 on the housing 22 of the primary operator 20 preventing the primary operator 20 from moving longitudinally to the left beyond the position shown in FIGS. 7 through 10. When the slider 36 reaches the position shown in FIG. 10, the inside operator 32 and the primary operator 20 are aligned. In the FIG. 10 condition, the free end of the prong 44 enters a recess indicated generally at 68 and the contact surface 56 of the prong 44 can engage the contact surface 60 of the boss 26. When the slider 36 of the inside operator 32 is moved to the right from the position shown in FIG. 10 to the position shown, for example; in FIG. 5, engagement between the contact surfaces 56 and 60 causes movement of the boss 26 of the primary operator to the right, also. Now that the operators 20 and 32 are aligned, the longitudinal position of the primary operator will now be controlled by longitudinal movement of the inside operator 32.

Thus, it will be seen that when the sash 14 is closed and the primary operator 20 and the inside operator 32 are aligned, the longitudinal position of the primary operator 20 is controlled by longitudinal movement of the inside operator 32. When the sash 14 is closed and the primary operator 20 and the inside operator 32 are not aligned, longitudinal movement of the inside operator 32 will bring them into alignment whereupon the longitudinal position of the primary operator 20 is again controlled by longitudinal movement of the inside operator 32.

Figure 11:
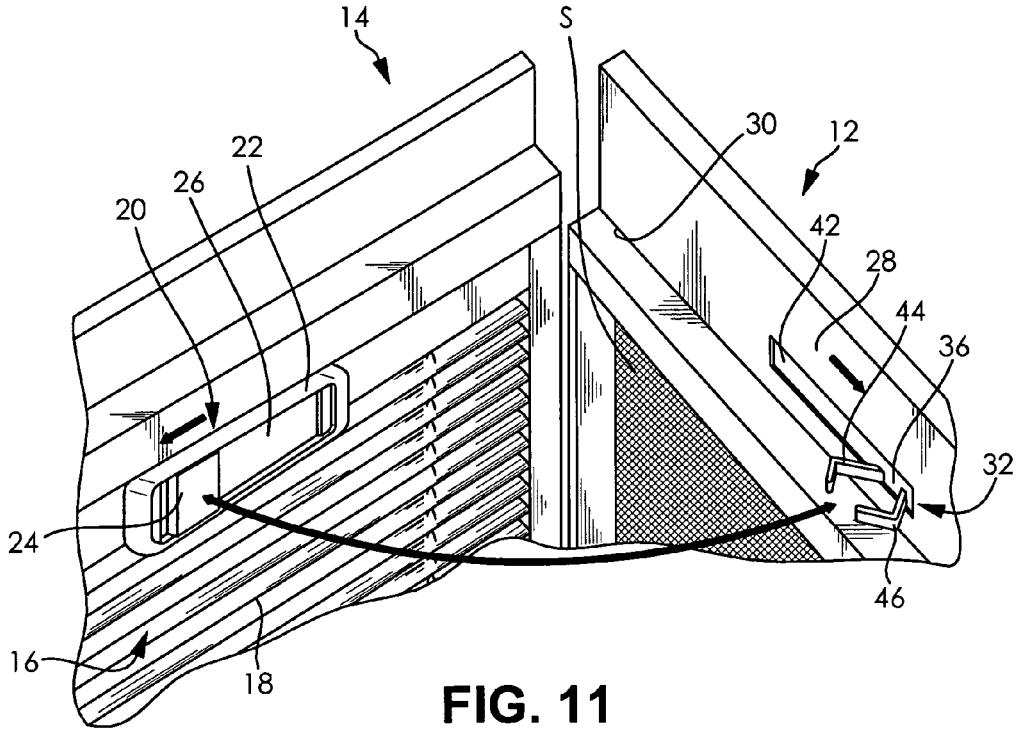
FIG. 11 is an upper perspective view of a window unit with a pivoting window sash in an open position with an internal Venetian type blind with slats in an open tilt orientation.
Figure 12:
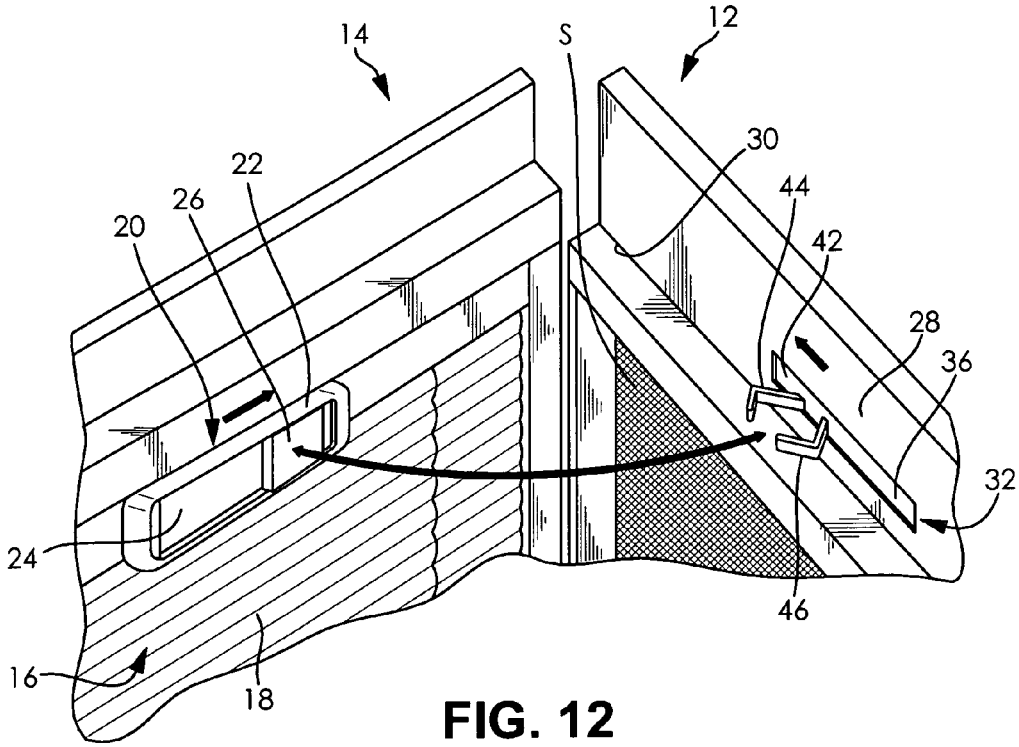
FIG. 12 is an upper perspective view of a window unit with a pivoting window sash in an open position with an internal Venetian type blind with slats in a closed tilt orientation.

In FIGS. 2, 11, and 12, the sash 14 is shown in an open position, i.e., it has been pivoted outwardly away from the window frame 12. A screen S is supported in the window frame. 12 so that access to the primary operator 20 on the sash 14 is prevented from inside of the window 10. The screen S might as well be a storm window or other transparent or translucent panel. When the sash 14 is closed, a person on the inside of the window 10 can operate the primary operator 20 with the inside operator 32 without having to remove the screen S or the like from the window frame 12. When the sash 14 is open, the inside operator 32 is ineffective because the primary operator 20 and the inside operator 32 are not engaged and can't engage. With the sash 14 open; longitudinal sliding movement of the inside operator-slider 36 has no effect on the longitudinal position of the primary operator slider 24.

The positions of the operators 20 and 32 in FIGS. 2, 11 and 12 are such that, when the sash 14 is closed, the operators 20 and 32 will be aligned and longitudinal movement of the inside operator slider 32 will effect a corresponding longitudinal movement of the primary operator slider 26. If the positions of the operators 20 and 32 are such that, when the sash 14 is moved from an open position to the closed position, the operators 20 and 32 will be not aligned but longitudinal movement of the inside operator slider 36 will bring the operators 20 and 32 into alignment as described above.

The inside operator 32 can be adapted to control the longitudinal position of a primary lift operator. In FIG. 1, a sash primary lift operator is indicated generally at 70. The primary lift operator 70 comprises an actuator 72 mounted for longitudinal sliding movement in a track 74. Such a primary lift operator is available from OEM Shades under the designation SSLT and is described as a magnetically coupled blind lift mechanism for installation in sealed insulated glass units. The lift position of a blind is controlled by the position of an externally mounted magnet assembly which is coupled to a corresponding internal magnet assembly. Thus, the actuator 72 may be an externally mounted magnet assembly and may be provided with a boss 76 for engagement by prongs of an inside operator (not shown) corresponding with the inside operator 32. Such an inside operator would be mounted for sliding movement on a portion of a window frame, such as a jamb frame insert 77 which is partially shown in FIG. 1 and would extend at least the length of the track 74. This arrangement would correspond with the arrangement previously described where the inside operator 32 is mounted on the head frame insert 28, for longitudinal sliding movement. The inside operator may be provided with a lock mechanism for positively locking the inside operator in a particular longitudinal position. A primary blind lift operator is also available from OEM Shades and it includes a magnet although the invention is suitable for use in conjunction with other lift operators.

The prong 46 (FIG. 4) may comprises a first, proximal leg 78 and a second, distal leg 79 and they form an angle Z between them when the prong is not flexed. The first leg 78 and a corresponding first leg of the prong 44 extend away from each other and the second leg 79 and a corresponding second leg of the prong 44 extend towards each other. When a prong is flexed, the angle between the first leg and the second leg gets smaller as indicated by dotted lines in FIG. 4 for the prong 44. Good results have been observed with prongs made from an automotive grade of polypropylene.

The prongs 44 and 46 may be modified so that each includes a brace like the brace 80 shown on prong 46 in FIG. 4. The brace 80 and a corresponding brace provided on prong 44 connect the outside of the first leg 78 of the prong 46 and the outside of the corresponding first leg of the prong 44 to the slider 36. The braces prevent or minimize any change in the angle between the first legs and the slider 36 when the prongs are flexed. In this case, most or all of the flexure takes place at an elbow 82 shown on prong 46 and at a corresponding elbow on prong 44. In this configuration, good results have been obtained in the case where prongs including braces corresponding with the brace 80 are configured so that the angle between a first leg and a second leg of a prong changes, as between the flexed and the unflexed condition, between about 15 and 35 degrees. A preferred range is between about 20 and 30 degrees. When the prongs include braces and one of the prongs is flexed, it is preferred that the upper surface 64 of the boss 26 and the second leg of the flexed prong form an angle between them of about zero degrees to 10 degrees. The prongs 44 and 46 are preferably symmetrical, as shown in the drawing Figures.

It will be appreciated that the inside operator of the present invention can be adapted to a wide variety of applications. These will be apparent to a person having ordinary skill in the field of fenestration considering the foregoing detailed description of the invention.

We claim:

1. A window assembly having an outside and an inside and comprising a window frame, a window sash supported on said window frame for pivotal movement between an open position and a closed position, a sash frame having an inside and an outside, an insulated glass unit with an internal blind supported in said sash frame, a primary operator supported in said sash for linear movement and operably connected to said blind so that linear movement of said primary operator causes movement of said blind, said primary operator including a boss extending inwardly from the inside of said sash, a housing supported in said window frame, and a secondary operator in said window frame housing, said secondary operator comprising a slider supported in said window frame housing for linear movement, said slider having a first prong extending outwardly from said slider and a second prong extending outwardly from said slider, wherein, when said window sash is in the closed position, said first and second prongs of said secondary operator engage said primary operator boss, and linear movement of said secondary operator causes linear movement of said primary operator, and wherein said window frame includes a frame insert and wherein said secondary operator is supported in said frame insert.

2. The window assembly claimed in claim 1 wherein said first and second prongs are V-shaped.

3. The window assembly claimed in claim 2 wherein said first and second prongs are flexible.

4. The window assembly claimed in claim 1 wherein said first and second prongs are flexible.

5. The window assembly claimed in claim 1 wherein said frame insert is a head frame insert and wherein said secondary operator is supported in said head frame insert.

6. The window assembly claimed in claim 1 wherein said frame insert is a jamb frame insert and wherein said secondary operator is supported in said jamb frame insert.

7. The window assembly claimed in claim 1 further comprising a housing supported in said sash frame wherein said primary operator is supported in said sash frame housing.

8. The Window assembly claimed in claim 7 wherein said sash frame housing includes first and second stops to limit the linear movement of said primary operator to movement between a first position and a second position.

9. The window assembly claimed in claim 8 wherein a recess is defined between said primary Operator boss and said sash frame housing when said primary operator is in said first position.

10. A window assembly having an outside and an inside and comprising a window frame, a window sash supported on said window frame for pivotal movement, relative to said window frame, between an open position and a closed position, a sash frame having an inside and an outside, an insulated glass unit with an internal blind supported in said frame, a first housing in said sash, a primary operator supported in said housing for linear movement between a first position and a second position, and operably connected to said blind so that linear movement of said primary operator causes movement of said blind, said primary operator including a boss extending inwardly from the inside of said sash, a second housing in said window frame, and a secondary operator supported in said second housing for linear movement between a first position and a second position, said secondary operator comprising a slider having a first prong extending outwardly from said secondary operator and a second prong extending outwardly from said secondary operator, therefrom, wherein, when said window sash is in the closed position, said first and second prongs of said secondary operator engage said primary operator boss so that linear movement of said secondary operator causes a corresponding linear movement of said primary operator, wherein said boss of said primary operator and said first housing define a recess when said primary operator is in said first position, and wherein said first prong of said secondary operator is received in said recess when said secondary operator is in said first position.

11. The window assembly claimed in claim 10 wherein said first and second prongs are V-shaped.

12. The window assembly claimed in claim 10 wherein said first and second prongs are flexible.

13. The window assembly claimed in claim 11 wherein said first and second prongs are flexible.

14. The window assembly claimed in claim 10 wherein said window frame includes a head frame insert and wherein said secondary operator is supported in said head frame insert.

15. The window assembly claimed in claim 10 wherein said window frame includes a jamb frame insert and wherein said secondary operator is supported in said jamb frame insert.

16. The window assembly claimed in claim 10 wherein said primary operator includes a first stop surface that prevents said primary operator from moving beyond said first position.

17. The window assembly claimed in claim 16 wherein said primary operator includes a second stop surface that prevents said primary operator from moving beyond said second position.

* * * * *